United States Patent [19]

Savage

[11] 4,099,806

[45] Jul. 11, 1978

[54] COMBINED OPTHALMIC LENS PATTERN RACK AND DISPENSER

[76] Inventor: Milton B. Savage, 500 Fifth Ave., New York, N.Y. 10036

[21] Appl. No.: 789,511

[22] Filed: Apr. 21, 1977

[51] Int. Cl.[2] ..... A47F 3/02

[52] U.S. Cl. ..... 312/117; 312/17; 312/234

[58] Field of Search ..... 312/17, 19, 117, 119, 312/234

[56] References Cited

U.S. PATENT DOCUMENTS

| | | | |
|---|---|---|---|
| 1,446,700 | 2/1923 | Hand | 312/17 |
| 2,402,044 | 6/1946 | Heckman | 312/17 |
| 2,402,076 | 6/1946 | Painter | 317/17 |
| 3,644,009 | 2/1972 | Tyler | 312/117 |
| 3,804,480 | 4/1974 | Chamberlin | 312/117 |

*Primary Examiner*—Casmir A. Nunberg
*Attorney, Agent, or Firm*—Albert F. Kronman

[57] ABSTRACT

A combined opthalmic lens pattern rack and dispenser having a shelved housing and a plurality of pattern receiving compartments on each shelf. The compartments are open at each end so as to be accessible from the front of the housing and in communication with a chute at the back of the housing. A pattern selecting and ejecting member is slidably carried on the housing in front of each shelf for desired location in register with a compartment. A movable arm on the selecting and ejecting member serves to push it into the chute for dispensing purposes.

1 Claim, 6 Drawing Figures

FIG.1
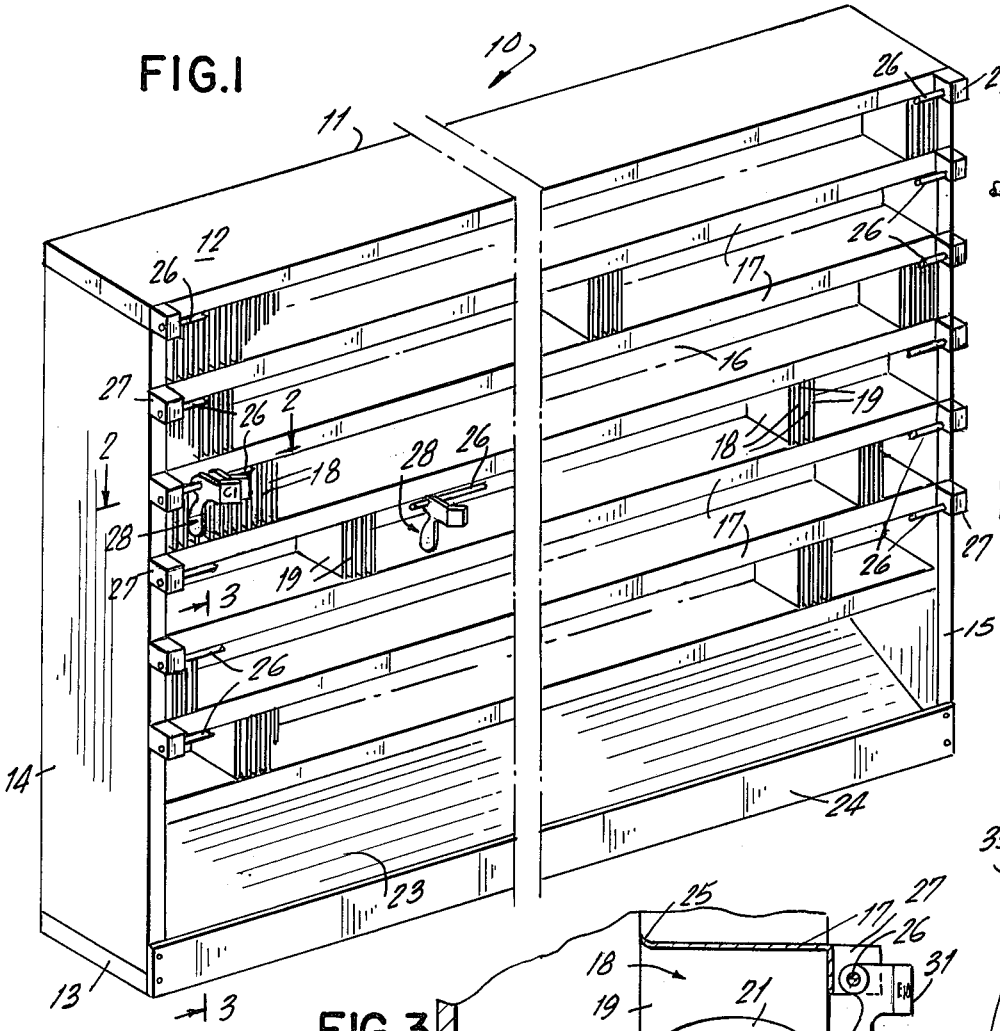
FIG.6
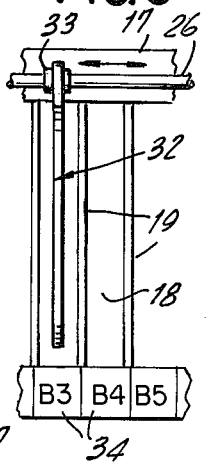
FIG.4
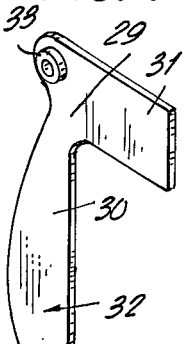
FIG.3
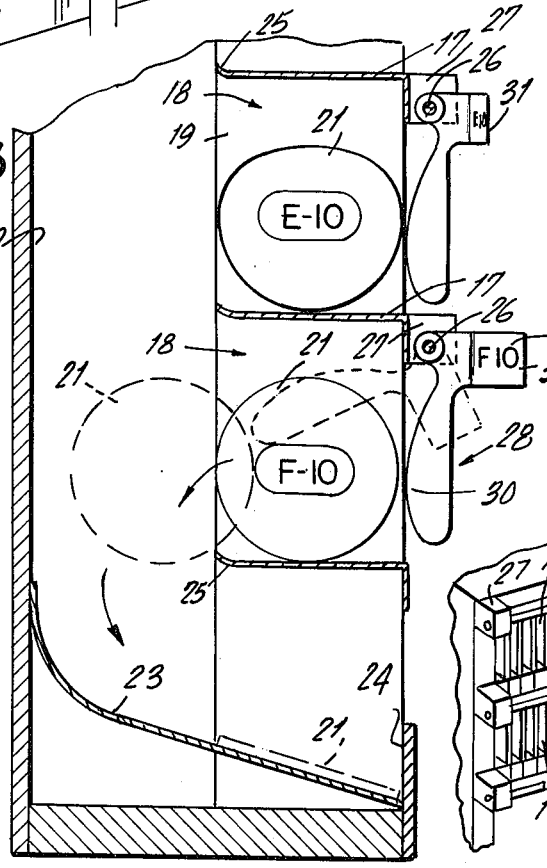
FIG.5
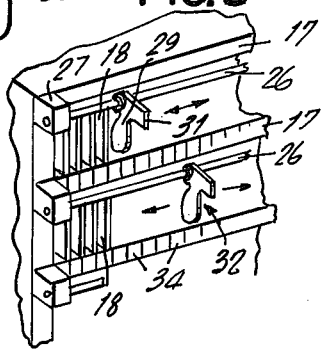
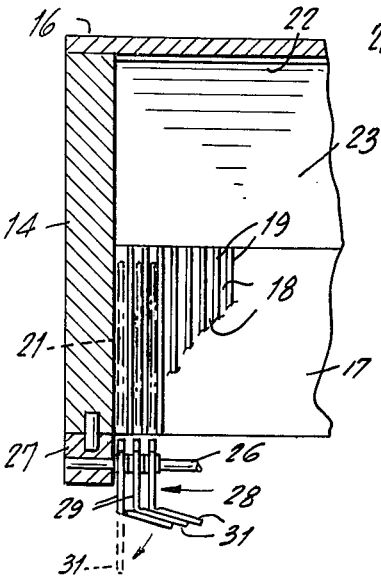
FIG.2

COMBINED OPTHALMIC LENS PATTERN RACK AND DISPENSER

BACKGROUND OF THE INVENTION

Opthalmic eyeglass lenses are ground from a circular disc shaped blank. After grinding, the lenses must be cut into the proper shape required by the frame. In order to cut the lens shape, there is provided a metal or plastic pattern for use in the lens cutting machine.

As a result of the recent proliferation in frame styles there has been a tremendous increase in the number of patterns provided to the optician in order for him to fill his requirements. Many opticians place a series of nails or hooks above their benches to hold the patterns. Some keep them in boxes marked with the names of the frame manufacturer, or the styles. Such solutions to the problem of selecting and using the patterns have proved to be unsatisfactory.

While it is known to provide cabinets for discs such as phonograph records as set forth in U.S. Pat. No. 2,402,076 such devices are not suitable for storing, dispensing and using small thin patterns.

Accordingly, it is an object of the present invention to provide a lens pattern rack and dispenser capable of storing a large number of patterns in a relatively small space.

Another object of the present invention is to provide a pattern rack which will faciliate the selection and dispensing of individual patterns.

A further object of the present invention is to provide a pattern rack for easy return of patterns after use.

Still another object of the present invention is to provide a pattern rack which will enable two or more opticians to work at a common location and use the same rack, quickly and accurately.

SUMMARY

The combined opthalmic lens pattern rack and dispenser of the present invention, consists of a housing having a top, bottom, sides, and rear walls and open at its front. A series of spaced shelves divide the area within the housing. The area between the shelves and between the shelves and the housing is further divided into a series of elongated compartments of a width which will freely receive a lens pattern therein. The compartments are open at their front to receive the lens patterns and at their rear to permit dispensing of the lens patterns into a chute which is provided at the back of the housing in communication with each of the compartments.

Selection and dispensing of individual patterns is accomplished by means of an ejecting member slidably carried on the housing in front of each shelf and having an arm which is swingable into the selected compartment so as to urge the pattern rearwardly and into the chute.

BRIEF DESCRIPTION OF THE DRAWINGS

In the accompanying drawing forming part hereof, similar elements have been given the same reference numeral, in which drawing;

FIG. 1 is a somewhat isometric view of a complete embodiment of the present invention with certian parts omitted for the sake of clarity.

FIG. 2 is a detailed view of one corner of the present invention showing an alternate pattern ejecting structure.

FIG. 3 is a framentary view in vertical cross section taken on line 3—3 in FIG. 1 somewhat enlarged.

FIG. 4 is an isometric view of the pattern ejecting member.

FIG. 5 is a fragmentary isometric view of the front of the lens pattern rack showing another form of pattern ejector.

FIG. 6 is a view similar to FIG. 5 in front elevation somewhat enlarged.

GENERAL DESCRIPTION

Referring to the drawing, 10 indicates a lens pattern rack and dispenser made in accordance with the present invention and having a housing 11. The housing consists of a top 12, bottom 13, spaced sidewalls 14, 15 and rear wall 16. A series of spaced horizontal shelves 17 divides the area within the housing and serve as the bottoms for a plurality of elongated compartments 18. The compartments are formed by spaced partitions 19 mounted normal to the shelves 17 and parallel to each other. The compartments 18 are of a width which will conveniently carry a thin disc-like lens pattern 21 best shown in FIG. 3. The lens patterns 21 are of non-circular configuration and made of thin sheets of metal or plastic. As is well known in the art, these patterns are used in lens cutting machinery to enable the finished lens to be inserted in a spectacle frame.

As will be seen from an examination of FIG. 3, the shelves 17 and partitions 19 end short of the rear wall 16 of housing 11. As a result, a chute 22 is formed at the back of the housing 11 which is in communication with each of the compartments 18. A small inclined ramp 23 at the bottom of the chute 22 serves to direct the pattern 21 toward the front of the housing where it may be removed from the device. A stop member 24 is disposed along the front bottom portion of the housing to prevent the patterns from falling out of the rack after they have been selected and ejected into the chute 22, in the manner hereinafter more fully described.

It will be noted that each of the patterns 21 is placed within one of the partitions 19 in the rack 10. The patterns are disposed on edge with their bottoms resting upon the shelf 17 forming the bottom of the partition in which they are disposed. If desired, a small lip 25 may be provided at the back of each of the shelves 17 to prevent accidental movement of the patterns 21 into the chute 22.

A plurality of elongated rods 26 are carried at their ends by brackets 27 attached at each side to the sidewalls 14, 15 of the housing 11. The rods 26 are located at the top of each row of partitions 19 and slidably support pattern ejecting members 28 thereon. One or more such ejecting members 28 may be carried upon each of the rods 26 depending upon the preferred type desired.

In the embodiment shown in FIG. 1, each compartment 18 is provided with its own ejecting member 28. The ejecting member consists of a body portion 29 a downwardly depending arm 30 and an outwardly extending tab 31. The tab 31 is hinged to the body portion 29 so that indicia 34 may be placed thereon for the convenience of the operator. By hinging the tab 31 a larger area can be provided for such indicia.

When it is desired to select a pattern using the embodiment shown in FIG. 1, the optician merely runs his finger along the tabs 31 until the proper one is found. Thereafter, the tab is straightened by means of the hinge construction and rotated upon the rod 26 so that the arm 30 enters the compartment 18 and urges the pattern 21 rearwardly and into the chute 22 as illustrated in FIG. 3.

After the pattern 21 has been used in the lens cutting machine, it is returned to the proper compartments by merely swinging the ejecting member 28 in a direction opposite that used for ejecting the pattern so that it clears the front of the partition. The pattern can then be slipped into place for subsequent dispensing.

It is within the purview of the present invention to use a single ejecting member 32 in the form shown in FIG. 4 slidably mounted upon the rod 26 for pattern dispensing purposes. The ejecting member 32 is made of thin flat sheet material of a thickness that will enable it to freely enter a lens compartment 18. The ejecting member 32 consists of a body portion 29 a depending arm 30 and a tab 31. The tab in this embodiment is not hinged but consists of a rigid member which is grasped by the operator to swing the ejecting member 32 into the lens pattern compartment 18 for dispensing the lens pattern in the manner herein above described in connection with FIGS. 1, 2 and 3. The body portion 29 of the ejecting member 32 is further provided with a small bushing 33 which is slidably received upon the rod 17 and provides a bearing surface for the lateral motion of the ejecting member when a specific pattern is being selected. In this embodiment the indicia for specific patterns is displayed on the shelf immediately below the compartment as shown in FIGS. 5 and 6. It will be apparent that the lens pattern rack and dispenser herein above described is capable of holding a large number of patterns for ready use in a comparatively small space. Thus for a rack of about 24 inches long, 28 inches high and five inches deep having compartments of only one eigth inch in width, and about 2½ inches high, a total of 750 lens patterns may be stored and handled.

The patterns may be quickly located by the optometrist, dispensed to the bottom of the chute and used. Thereafter, the patterns may be returned to the rack in their proper location ready for subsequent use in a minimum amount of time.

Having thus fully described the invention what is desired to be claimed and secured by Letters Patent is:

1. A lens pattern rack and dispenser comprising a hollow housing having spaced side walls, a bottom, a top and rear wall, at least one shelf dividing the area within the housing, a plurality of upstanding spaced partitions on the shelf, said shelf and partitions disposed normal to the plane of the rear wall and spaced therefrom, said partitions further dividing the area into a plurality of lens pattern receiving compartments, a chute adjacent the rear wall of the housing in communication with each of the compartments, said chute having an inclined ramp at the bottom thereof and ejecting means comprising a body portion, a depending arm on said body portion and an actuating tab extending from said body portion, said ejecting means further comprising at least one pivotally mounted member swingably carried by the housing laterally slidable upon an elongated rod on the front of the housing and opposite the rear wall to urge lens patterns out of their respective compartments and into the chute, and registerable with at least one of said compartments.

* * * * *